US005914695A

United States Patent [19]

Liu et al.

[11] Patent Number: 5,914,695

[45] Date of Patent: Jun. 22, 1999

[54] OMNIDIRECTIONAL DIPOLE ANTENNA

[75] Inventors: Duixian Liu, Ossining; Modest Michael Oprysko, Mahopac, both of N.Y.

[73] Assignee: International Business Machines Corporation, Armonk, N.Y.

[21] Appl. No.: 08/783,938

[22] Filed: Jan. 17, 1997

[51] Int. Cl.[6] ..... H01Q 9/28

[52] U.S. Cl. ..... 343/795; 343/802

[58] Field of Search ..... 343/700 MS, 795, 343/802, 803, 806, 807, 860; H01Q 9/28

[56] References Cited

U.S. PATENT DOCUMENTS

| | | | |
|---|---|---|---|
| 3,887,925 | 6/1975 | Ranghelli et al. | 343/795 |
| 5,229,782 | 7/1993 | Hemmie et al. | 343/795 |
| 5,767,809 | 6/1998 | Chuang et al. | 343/700 MS |

*Primary Examiner*—Don Wong
*Assistant Examiner*—Tan Ho
*Attorney, Agent, or Firm*—Robert P. Tassinari, Jr.

[57] ABSTRACT

The invention is a novel antenna configuration that has a substantially smaller size than existing antennas tuned to a given frequency. Compact size is provided without substantial loss in performance, making the antenna particularly suitable for hand-held devices. An antenna in accordance with the invention is preferably situated on an FR4 substrate, and includes a dipole having first and second pairs of copper radiating strips, one pair on each of the top and bottom surfaces of the substrate. Each radiating strip in a pair has a copper conductive strip coupled thereto, the strip of one radiating element being situated on the same surface of the substrate as the respective strip, with the conducting element of the other radiating strip being disposed on the opposite surface of the substrate. The effect of the configuration is to lengthen the radiating strips without an increase in substrate dimensions, thereby allowing tuning to low frequencies for a given substrate size. An on-board matching network includes adjustable capacitance and inductance to match the impedance of the antenna with that of a connector coupled to an off-substrate transceiver. A preferred implementation for a 900 MHz antenna is described.

8 Claims, 7 Drawing Sheets

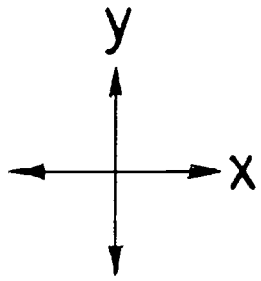
FIG. 6
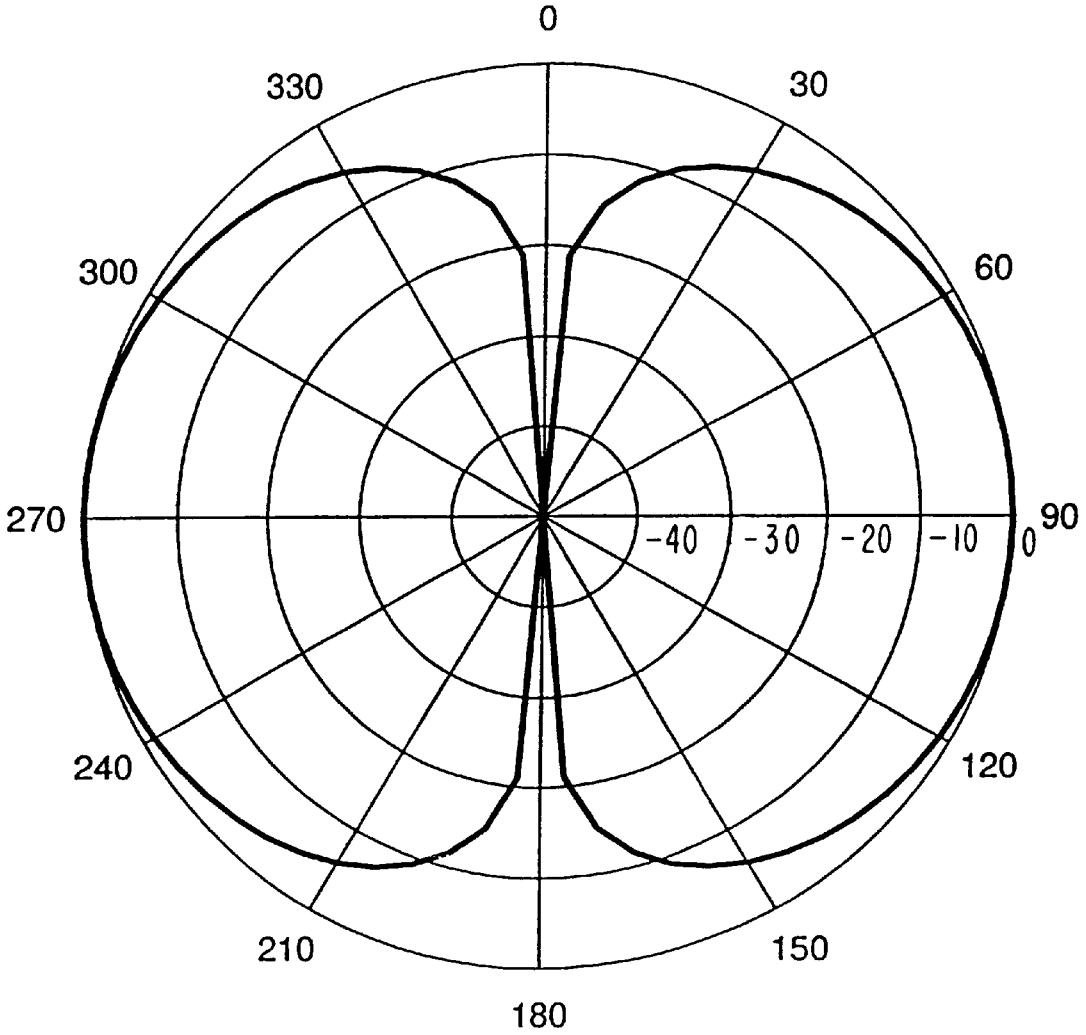

OMNIDIRECTIONAL DIPOLE ANTENNA

FIELD OF THE INVENTION

The present invention is related generally to antennas, and more specifically it relates to a printed dipole radio frequency antenna having a matching circuit.

BACKGROUND OF THE INVENTION

Printed dipole antennas that include a pair of straight conducting strips on a printed circuit substrate are known in the art. The substrate can be, for instance, a material such as FR4, GETEK, DUROID or TEFLON. The dipoles in these prior antennas typically are a half-wavelength long, and are characterized by a radiation resistance of between 50 to 70, depending on substrate thickness, dielectric constant of the substrate, and the width of the metal strips of the antennas.

A problem arises with such antennas when used in applications with restrictive size constraints, since the length of the dipole may be unacceptably long. For example, in a 900 MHz application, half the wavelength is approximately 16 cm. The size of an antenna having this length is prohibitively large for many applications.

One solution to this problem that has been proposed is to shorten the dipole length. The result of this solution, however, is an antenna having a very low radiation resistance, and which does not resonate. Further, the efficiency of such small antennas is extremely poor.

Clearly, as the need for compact, efficient antennas increases, an improved antenna design is required.

SUMMARY OF THE INVENTION

It is an object of the present invention to provide an antenna of compact size and good efficiency.

It is a further object of the invention to provide an omnidirectional antenna of compact size which can be manufactured inexpensively.

It is a further object of the invention to provide a compact, omnidirectional antenna which is operational at a frequency of 900 MHz and above.

In accordance with the foregoing objects, the invention is an antenna including a printed dipole and matching network and frequency-adjusting circuitry.

The invention is an antenna, comprising: a substrate having an upper surface and a lower surface; first and second radiating strips disposed on the upper surface of the substrate, the first and second radiating strips each having a first end and a second end, wherein the first end of the first radiating strip is connected to the first end of the second radiating strip to form a first feed point; third and fourth radiating strips disposed on the lower surface of the substrate, the third and fourth radiating strips each having a first end and a second end, wherein the first end of the third radiating strip is connected to the first end of the fourth radiating strip to form a second feed point; a first conductive strip coupled to the second end of the first radiating strip; a second conductive strip coupled to the second end of the second radiating strip; a third conductive strip coupled to the second end of the third radiating strip; a fourth conductive strip coupled to the second end of the fourth radiating strip; wherein the first and third conductive strips are disposed on the upper surface of the substrate, the second and fourth conductive strips are disposed on the lower surface of the substrate, and the first and second connection points are coupled to one another via an impedance network.

BRIEF DESCRIPTION OF THE DRAWING

FIG. 6 is a second radiation pattern plot of the preferred implementation of the antenna of the present invention.

DETAILED DESCRIPTION OF THE INVENTION

Figure 1:
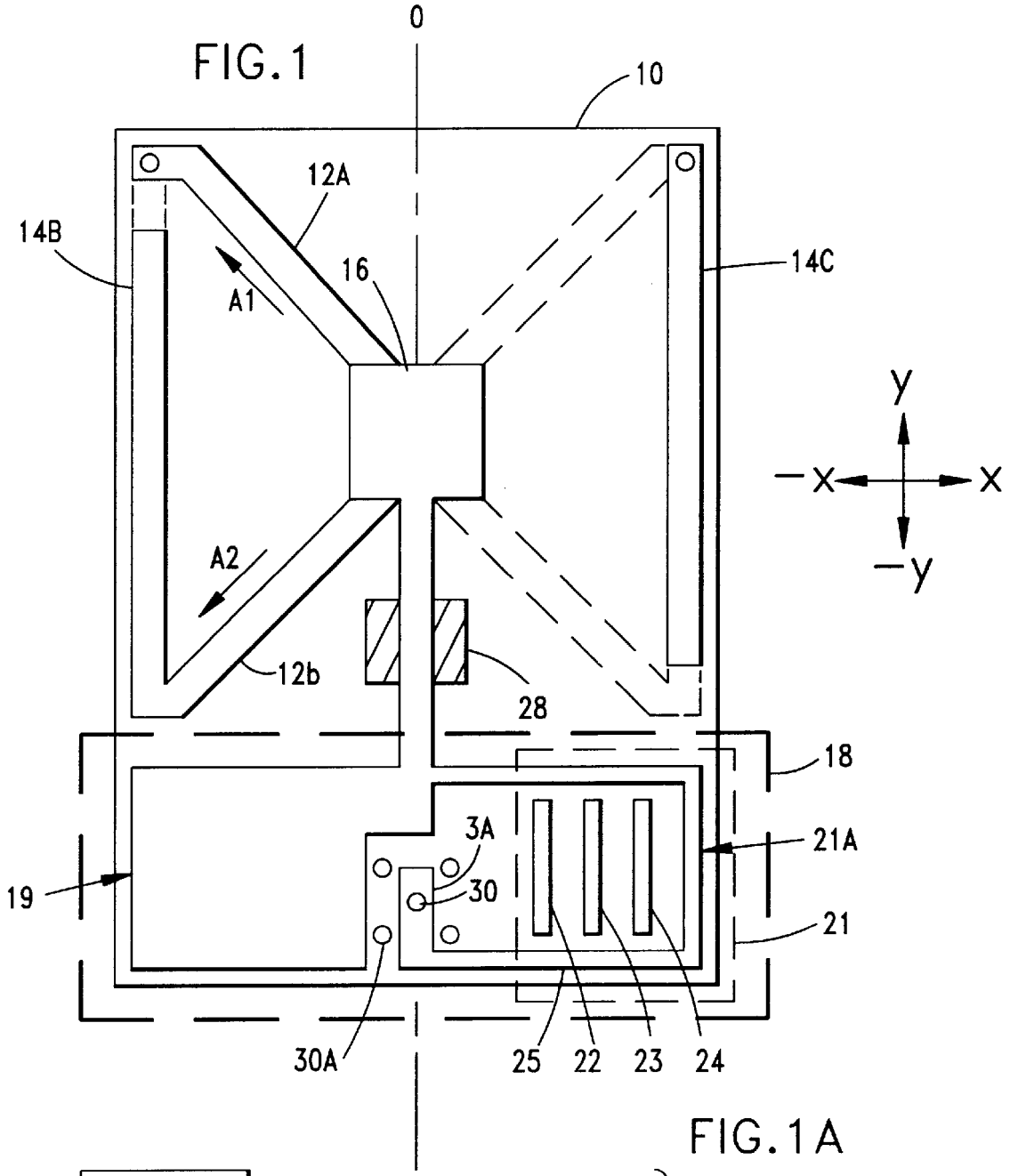
FIG. 1 is a top view of a preferred antenna according to the invention.
Figure 1:
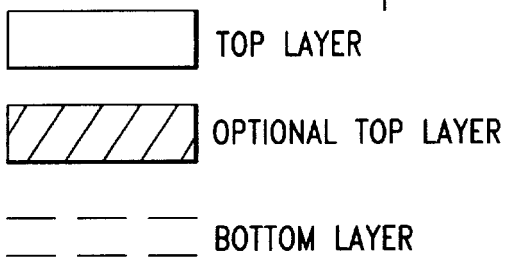
Figure 2:
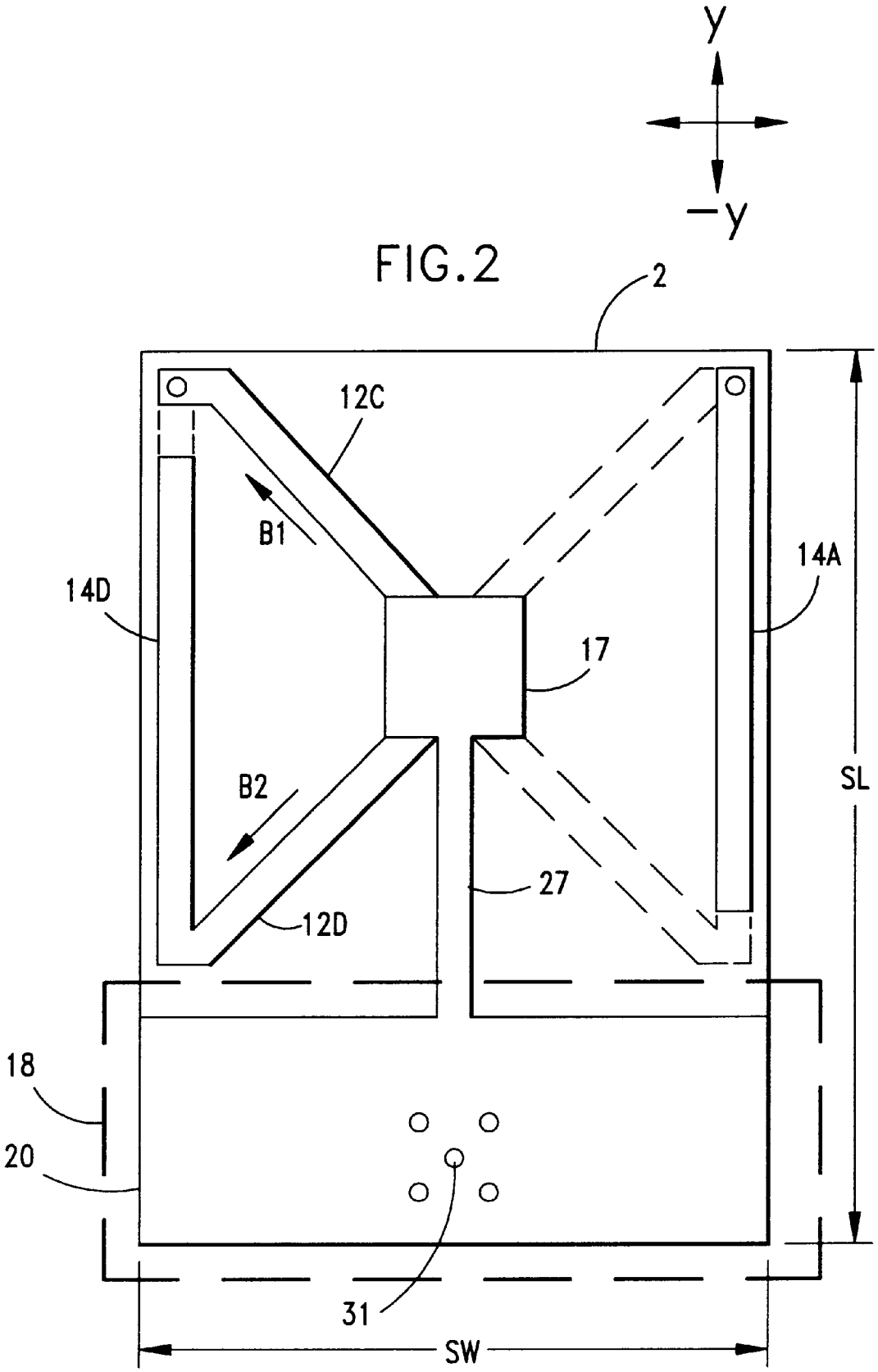
FIG. 2 is a bottom view of the antenna of FIG. 1.
Figure 3:
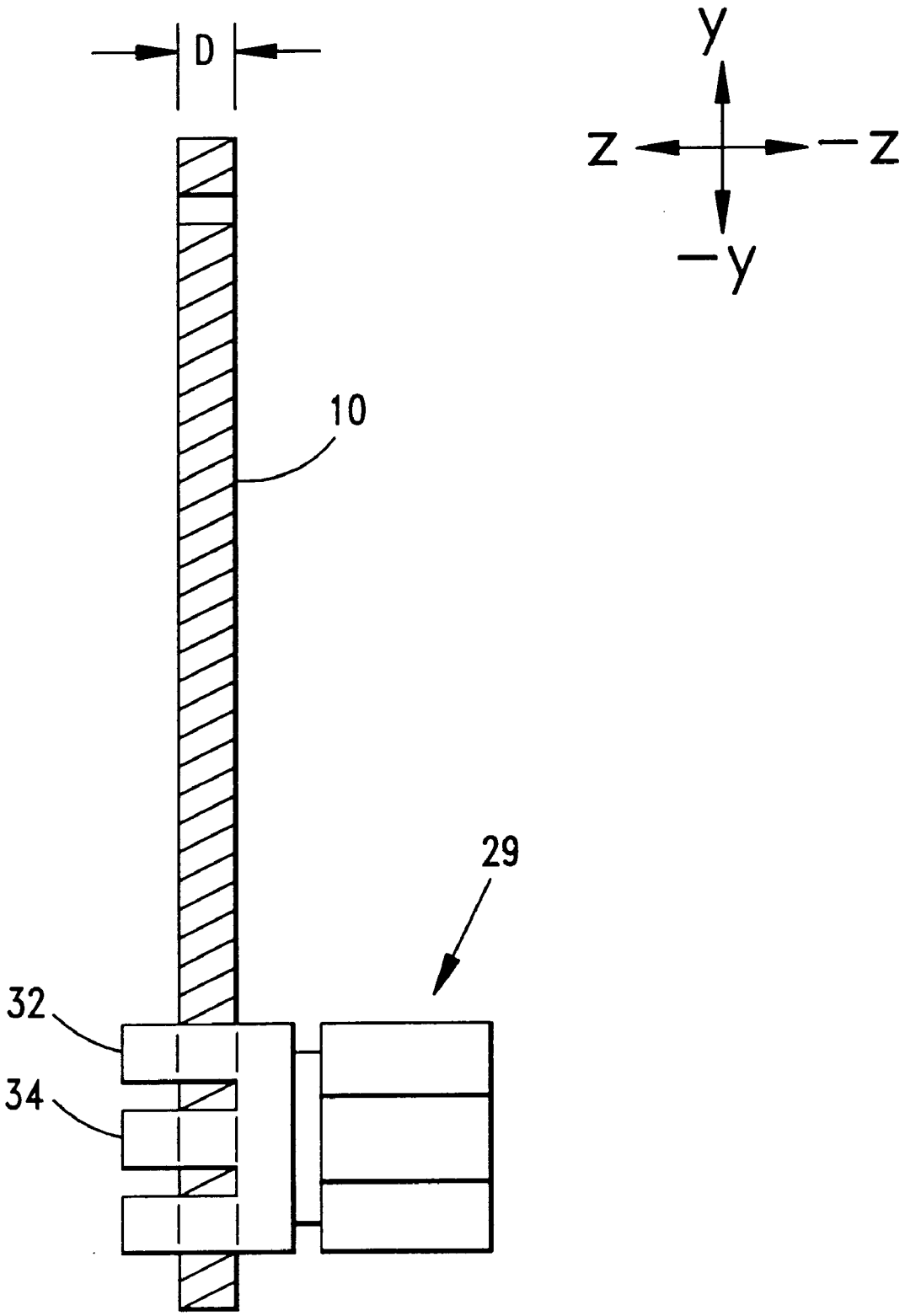
FIG. 3 is a side view of the antenna of FIG. 1.

Referring now to FIGS. 1–3, a preferred implementation of the invention will be described in detail.

FIG. 1 is a top view of a preferred implementation of an omnidirectional antenna, with matching network circuitry. The antenna is disposed on a printed circuit board substrate 10, having an upper surface (shown in FIG. 1) and a lower surface (shown in FIG. 2). The antenna portion of the substrate 10 (i.e., distinguished from that portion of the substrate that includes the matching network circuitry) is made from FR4 material and has dimensions of approximately 4.3 cm×3.4 cm×0.15 cm. Copper dipole antenna radiating elements 12*a*, 12*b*, 12*c* and 12*d* are disposed on the upper and lower surfaces of the substrate in the manner shown in FIGS. 1 and 2. More specifically, radiating elements 12*a* and 12*b* are disposed on the upper surface of the substrate and directed along A1 and A2, respectively, and radiating elements 12*c* and 12*d* are disposed on the lower surface of the substrate, and are directed along B1 and B2, respectively. The function of the radiating strips is to collect/radiate RF energy. Radiating elements 12*a* and 12*b* intersect at respective first ends thereof. The intersection of the two ends is referred to as a feed point. Similarly, radiating elements 12*c* and 12*d* intersect at respective first ends thereof. As can be seen with reference to the x-y coordinates displayed in FIGS. 1 and 2, the pair of radiating elements comprising elements 12*a* and 12*b* and the pair of radiating elements comprising elements 12*c* and 12*d* are disposed symmetrically about the y-axis. This configuration serves to maximize the radiation efficiency of the antenna and to provide a symmetrical radiation pattern.

Each of radiating elements 12*a–d* is constructed from copper, and has dimensions in a preferred 900 MHz implementation of 2.5 cm×0.2 cm×0.0025 mm.

Coupled to each one of the radiating elements 12*a–d* is a conductive strip 14*a–d*, which provides capacitive loading for its respective radiating element. As shown, conductive strip 14*b* is disposed on the upper surface of the substrate and is coupled to radiating element 12*b*. Conductive strip 14*c* is also disposed on the upper surface of substrate 10, but is electrically coupled to radiating element 12*c* on the lower surface of the substrate. This connection can be made via a plated through-hole, or by means of a conductor strap wrapped around the edge of the substrate. Similarly, conductive strip 14*a* is disposed on the surface opposite that of radiating element 12*a*, but is electrically coupled therewith. Conductive strip 14*d* is disposed on the lower surface of the substrate 10 and is coupled to radiating element 12*d*.

The effect of providing the conductive strips 14*a–d* is to reduce the height of the antenna in the x-direction. This is because the conductive strips provide a capacitive load for the attached radiating strip. The antenna will, therefore, resonate at a wavelength four times the length of the conductive strips.

In the preferred 900 MHz implementation of the invention, the conductive strips 14*a–d* will each be made from copper and have dimensions of 3.5 cm×0.2 cm×0.0025 mm.

Also provided are a pair of conducting patches 16 and 17. Each conducting patch, preferably made from copper and having dimensions of about 0.8 cm×0.8 cm×0.0025 mm in the preferred 900 MHz implementation, is disposed as shown in FIGS. 1 and 2 at the first and second feed points of the antenna.

Conducting patches 16 and 17 serve to adjust the frequency of the antenna. Increasing the patch size will reduce the resonating frequency of the antenna. Although patches 16 and 17 are shown as squares, other shapes can be used with similar effect. The pertinent parameter of any such patch is its area. It is also desirable that patches 16 and 17 have the same shape and area, to provide symmetry in the z-dimension (shown in FIG. 3).

Figure 1A:
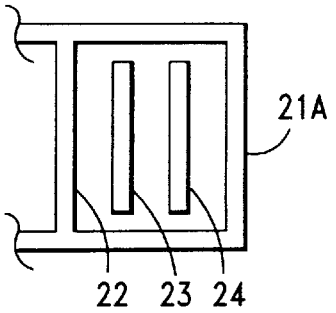
FIG. 1*a* shows a portion of the matching network of the antenna of FIG. 1.

The radiating elements 12*a* and 12*b* on the upper surface and elements 12*c* and 12*d* on the lower surface constitute a dipole. In a preferred implementation, the dipole is connected to a matching network 18. The matching network 18 includes a capacitor comprising a first plate 19 disposed on the upper surface of the substrate, and a second plate 20 disposed on the lower surface of the substrate. Substrate 10 acts as the dielectric between plates 19 and 20. The matching network also includes an adjustable inductor 21, disposed on the upper surface of the substrate, and coupled to the capacitor. The inductor includes strips 22, 23, 24, preferably made from copper, which can optionally be coupled to conductor 21*a* of the inductor circuit to adjust the inductance thereof. When the ends of strip 22, for example, are coupled to conductor 25, as shown in FIG. 1*a*, it provides an alternative, lower impedance current path to that provided by strip 21*a*, and a majority of the circuit's current will flow through that path.

An optional matching element 28, which preferably is a copper patch, can be added to the circuit as shown in FIG. 1. Specifically, the patch can be placed on conductor 26 to provide tuning for the antenna. The purpose of matching element 28 is to adjust the impedance of the antenna circuitry, as sensed at point 31*a*, in order to ensure that the impedance of the antenna (in a preferred implementation of the invention, the antenna has a radiation resistance of less than 10 ohms) matches that of connector 29. Thus, patch 28 provides a facility for widening the antenna tuning range. In a preferred 900 MHz implementation of the invention, element 28 will have dimensions of about 1 cm×0.6 cm×0.0025 mm.

FIG. 3 is a side view of the antenna of FIGS. 1 and 2, with the addition of a connector 29. Connector 29 provides an electrical connection between the matching network 18 and external circuitry, such as a receiving circuit. Connector 29, which in a preferred implementation is a coaxial connector, includes a center pin 34 which can be inserted into hole 30 to make contact with portion 3*a* of the matching network 18, and one or more outer pins 32, which can be inserted into holes 30*a* to make contact with region 20 on the lower surface of substrate 10.

Figure 4:
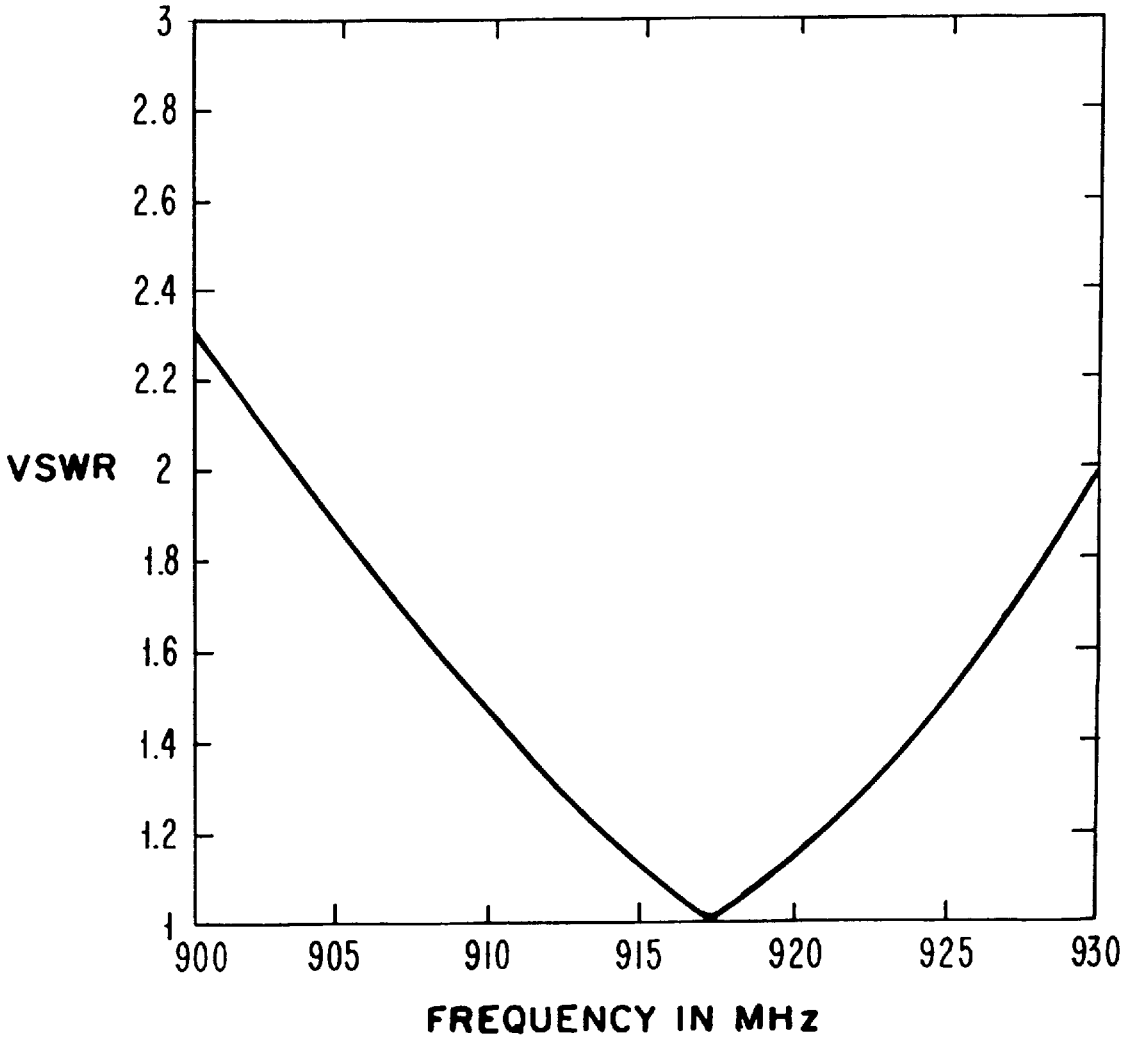
FIG. 4 is a plot of frequency vs. VSWR for a preferred implementation of the antenna of the present invention.

FIG. 4 is a plot of Voltage Standing Wave Ratio (VSWR) vs. Frequency for a preferred 900 MHz implementation of an antenna in accordance with the invention. It is desirable that VSWR have a value of 1 at the desired reception/transmission frequency. In a preferred implementation, VSWR will have a value of 1 at a frequency of about 917 MHz, as shown in FIG. 4. The VSWR can be adjusted to attain a desired frequency at the time of manufacture by adjusting, for instance, the size of patches 16 and 17.

Figure 5:
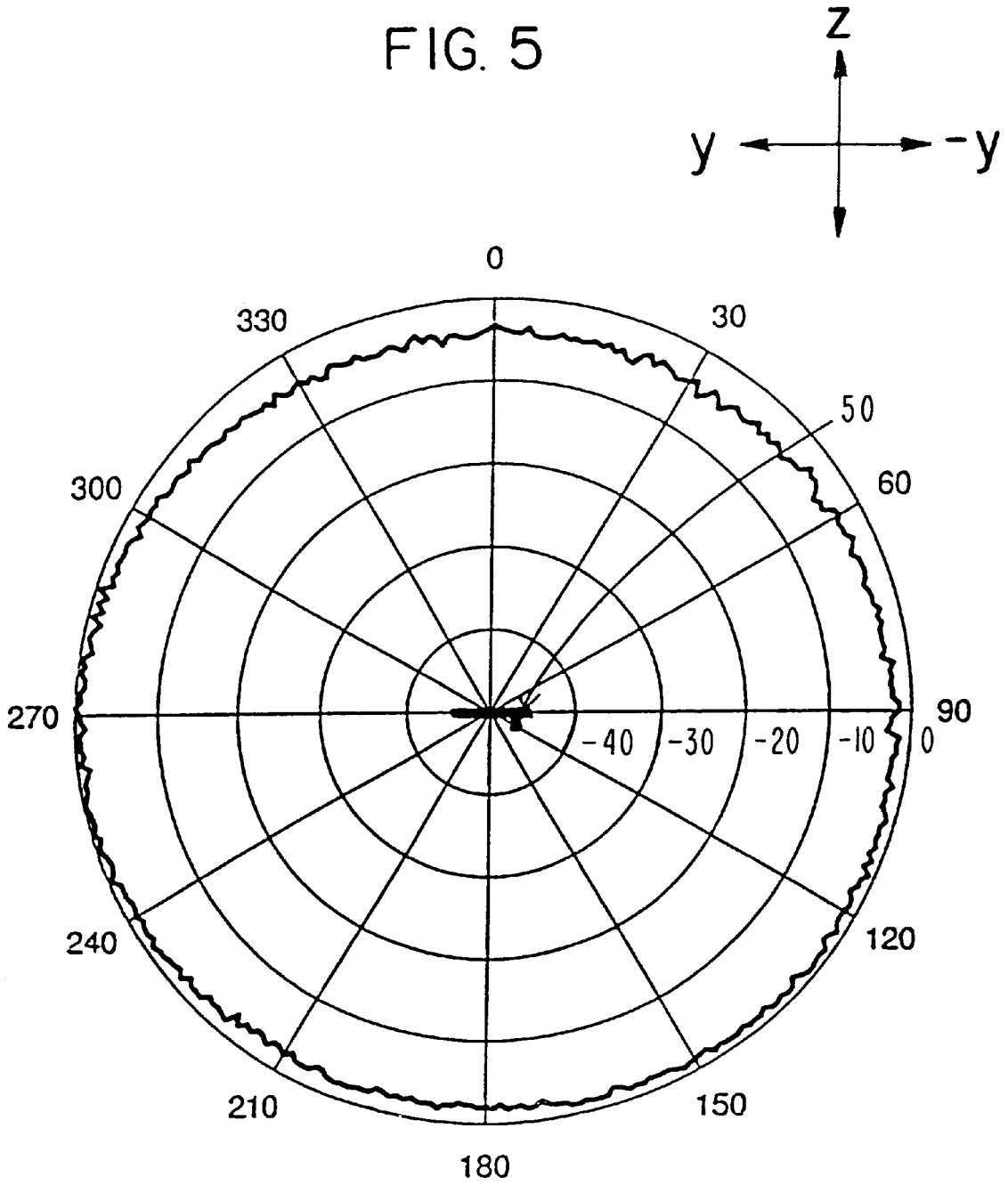
FIG. 5 is a radiation pattern plot for a preferred implementation of the antenna of the present invention.

FIG. 5 shows the radiation pattern for a preferred implementation of an antenna in accordance with the invention. The graph also includes a miniature representation 50 of the antenna of the present invention. The radiation pattern in FIG. 5 is for the y-z plane, and it can be seen that the radiation pattern is omnidirectional in that plane.

FIG. 6 is a second radiation pattern representation of a preferred antenna according to the present invention, this time taken in the x-y plane. The pattern is similar, although not shown, for the x-z plane.

Figure 7:
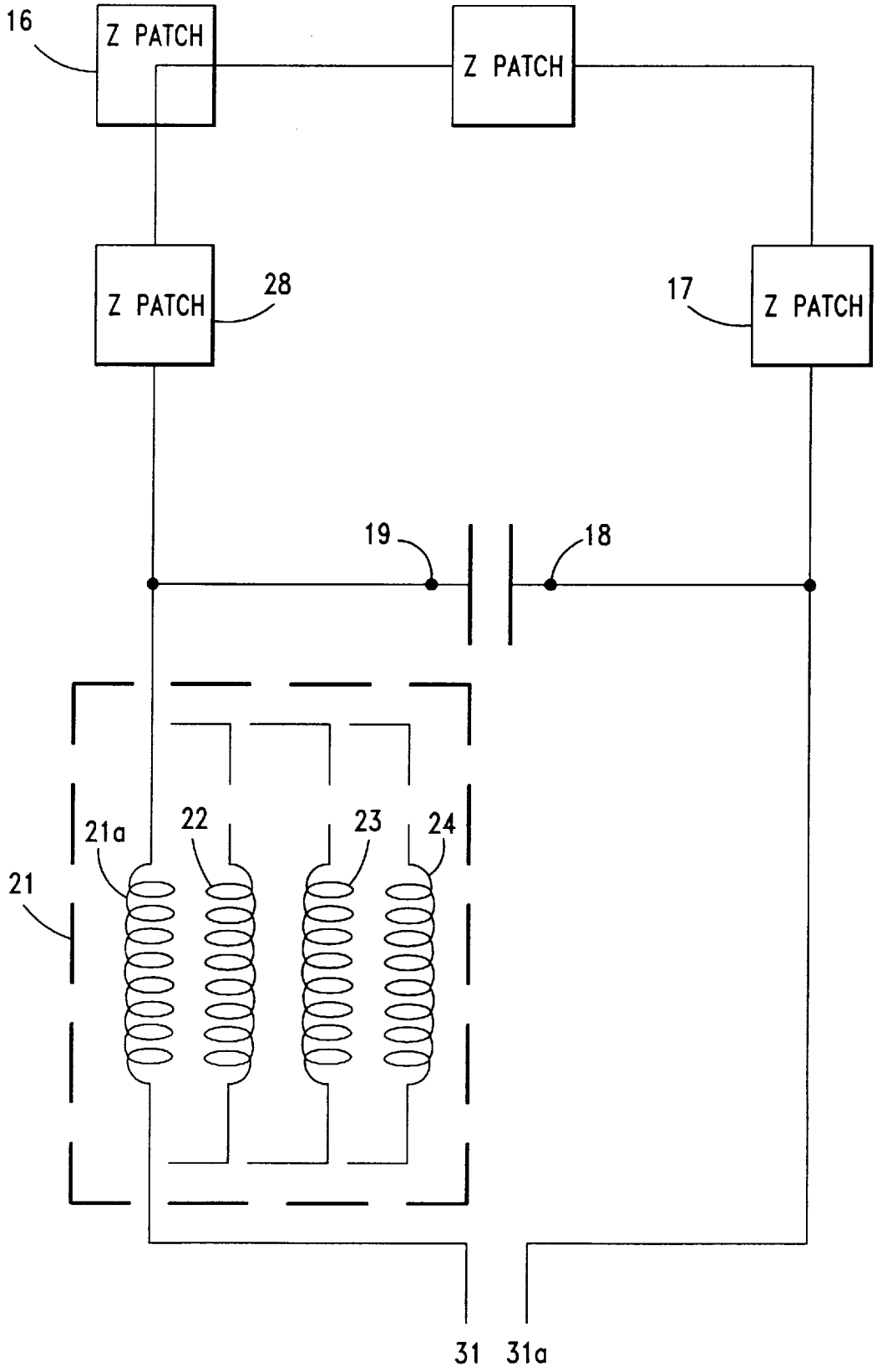
FIG. 7 is a schematic circuit representation of the antenna of FIG. 1.

FIG. 7 is a schematic circuit representation of the antenna of FIG. 1. The components of FIG. 7 have reference numerals corresponding to the appropriate components of FIGS. 1 and 2.

While the invention has been described in particular with preferred embodiments thereof, it will be understood that modifications to the disclosed embodiments can be effected without departing from the spirit and scope of the invention.

We claim:

1. An antenna, comprising:

a substrate having an upper surface and a lower surface;

first and second radiating strips disposed on the upper surface of the substrate, the first and second radiating strips each having a first end and a second end, wherein the first end of the first radiating strip is connected to the first end of the second radiating strip to form a first feed point;

third and fourth radiating strips disposed on the lower surface of the substrate, the third and fourth radiating strips each having a first end and a second end, wherein the first end of the third radiating strip is connected to the first end of the fourth radiating strip to form a second feed point;

a first conductive strip coupled to the second end of the first radiating strip;

a second conductive strip coupled to the second end of the second radiating strip;

a third conductive strip coupled to the second end of the third radiating strip;

a fourth conductive strip coupled to the second end of the fourth radiating strip;

wherein the first and third conductive strips are disposed on the upper surface of the substrate, the second and fourth conductive strips are disposed on the lower surface of the substrate, and the first and second connection points are coupled to one another via an impedance network.

2. The antenna of claim 1, wherein a first pair of radiating strips comprising the first and second radiating strips, and a second pair of radiating strips comprising the third and fourth radiating strips are disposed substantially symmetrically about an axis O.

3. The antenna of claim 2, further comprising a first conductive patch disposed on the first feed point, and a second conductive patch disposed on the second feed point.

4. The antenna of claim 3, wherein the first and second patches have substantially identical dimensions.

5. The antenna of claim 3, wherein the radiating strips, the conductive strips and the conductive patches are each made from copper.

6. The antenna of claim 1, wherein the antenna is tuned to approximately 900 MHz.

7. The antenna of claim 1, wherein the matching network comprises an adjustable capacitance and an adjustable inductance.

8. The antenna of claim 7, wherein the impedance of the antenna, including matching network equals that of a connector coupling the antenna to a transceiver.

* * * * *

UNITED STATES PATENT AND TRADEMARK OFFICE

CERTIFICATE OF CORRECTION

PATENT NO. : 5,914,695

DATED : June 23, 1999

INVENTOR(S) : Duixian Liu, et. al.

It is certified that error appears in the above-identified patent and that said Letters Patent is hereby corrected as shown below:

Drawings:

In FIG. 2, change "31" to --31a--.

In FIG. 2, delete "2" and the associated leader.

In FIG. 7, change the unnumbered block legend from "Z PATCH" to --Z ANTENNA-- but retain the notation "Z PATCH" for numbered blocks 16, 17 and 28.

Signed and Sealed this

Fifth Day of December, 2000

*Attest:*

Q. TODD DICKINSON

*Attesting Officer*

*Director of Patents and Trademarks*